US007228044B2

(12) United States Patent
Kamiyama et al.

(10) Patent No.: US 7,228,044 B2
(45) Date of Patent: Jun. 5, 2007

(54) COMPOSITE FIBER WITH LIGHT INTERFERENCE COLORING FUNCTION

(75) Inventors: Mie Kamiyama, Ehime (JP); Koichi Iohara, Ehime (JP)

(73) Assignee: Teijin Fibers Limited, Osaka (JP)

( * ) Notice: Subject to any disclaimer, the term of this patent is extended or adjusted under 35 U.S.C. 154(b) by 0 days.

(21) Appl. No.: 10/569,965

(22) PCT Filed: Aug. 25, 2004

(86) PCT No.: PCT/JP2004/012585

§ 371 (c)(1),
(2), (4) Date: Feb. 28, 2006

(87) PCT Pub. No.: WO2005/021849

PCT Pub. Date: Mar. 10, 2005

(65) Prior Publication Data

US 2007/0009221 A1 Jan. 11, 2007

(30) Foreign Application Priority Data

Aug. 28, 2003 (JP) ..... 2003-304271

(51) Int. Cl.
*G02B 6/02* (2006.01)
*G02B 6/10* (2006.01)

(52) U.S. Cl. ..... 385/131; 385/123; 385/143; 385/145

(58) Field of Classification Search ..... None
See application file for complete search history.

(56) References Cited

U.S. PATENT DOCUMENTS 6,430,348 B1 8/2002 Asano et al.
6,706,651 B2 * 3/2004 Hamajima et al. ..... 442/192

FOREIGN PATENT DOCUMENTS

EP 0 921 217 A1 6/1999
WO WO 1998/046815 A1 10/1998

* cited by examiner

*Primary Examiner*—Sung Pak
*Assistant Examiner*—Tina Wong
(74) *Attorney, Agent, or Firm*—Sughrue Mion, PLLC

(57) ABSTRACT

A novel conjugate fiber with a fine and an optical interference color-generating function, suitable for application in product fields which require aesthetic qualities, the fiber being characterized by having a structure wherein an alkali-soluble polymer with a thickness of 2.0 μm or greater surrounds an alternating laminated section with a thickness of no greater than 10 μm, comprising alkali-insoluble polymer layers with different refractive indices alternately laminated parallel to the long axis direction of the flat cross-section, wherein the ratio (SP1/SP2) between the solubility parameter value of the higher refractive index polymer (SP1) and the solubility parameter value of the lower refractive index polymer (SP2) is in the range of 0.8–1.1.

20 Claims, 1 Drawing Sheet

(1)

(2)

(3)

(1)

(2)

(3)

COMPOSITE FIBER WITH LIGHT INTERFERENCE COLORING FUNCTION

CROSS REFERENCE TO RELATED APPLICATION

This application is a U.S. National Stage Filing under 35 U.S.C. 371 from International Application No. PCT/JP04/12585 filed Aug. 25, 2004, which claims the benefit under Japanese Patent Application No. 2003304271 filed Aug. 28, 2003.

TECHNICAL FIELD

The present invention relates to a conjugate fiber with an optical interference color-generating function. More specifically, it relates to a novel conjugate fiber with an optical interference color-generating function which can be used as an excellent brightening for a variety of fields of use, and which can be easily obtained as a high quality fine fiber having an optical interference color-generating function by treatment with an aqueous alkali solution or the like.

BACKGROUND ART

Conjugate fibers having an optical interference color-generating function, composed of mutually independent polymer layers with different refractive indices forming an alternating laminate, produce interference coloring of wavelengths in the visible light region due to the reflection and interference effects of natural light. The color development has a brightness with a metallic gloss, and produces a pure and clear color (monochromatic) with a specific wavelength, while exhibiting an aesthetic quality entirely different from color formed by the light absorption of a dye or pigment. A concrete example of a conjugate fiber having an optical interference color-generating function is disclosed in International Patent Publication No. WO98/46815.

However, when it is attempted to increase the fineness of the conjugate fiber having an optical interference color-generating function as disclosed in the aforementioned international patent publication, peeling of the alternate laminated layers may occur, or even when peeling does not occur the spinning condition may be impaired due to degradation of the polymer during spinning or the optical interference effect may be reduced by unevenness produced during the drawing step; this has constituted an impediment against development of the fiber to product applications which require improved aesthetic qualities, particularly for paints which must have a fine fiber size, cut fibers for such purposes as cosmetics and printing, and even for some filament uses.

DISCLOSURE OF THE INVENTION

It is an object of the present invention to solve the aforementioned problems and provide a novel conjugate fiber which allows a fine conjugate fiber with an excellent optical interference color-generating function to be obtained by post-treatment, for development in commercial fields in which aesthetic qualities are demanded.

According to research by the present inventors, it was found that even with a small thickness of the alternating laminated section, if the structure includes a polymer covering the periphery then it is possible to inhibit peeling of the alternating laminated section and improve uniformity during the drawing step, and that if the covering polymer is later removed from the conjugate fiber, it is possible to obtain a stable fine conjugate fiber with an excellent optical interference color-generating function.

Specifically, a conjugate fiber with an excellent optical interference color-generating function according to the invention, which can achieve the object stated above, is characterized in that an alternating laminated section with a thickness of no greater than 10 μm, wherein alkali-insoluble polymer layers with different refractive indices are alternately laminated parallel to the long axis direction of the flat cross-section and the ratio (SP ratio) between the solubility parameter value of the higher refractive index polymer (SP1) and the solubility parameter value of the lower refractive index polymer (SP2) is in the range of $0.8 \leqq SP1/SP2 \leqq 1.1$, is covered with an alkali-soluble polymer with a thickness of 2.0 μm or greater.

BRIEF DESCRIPTION OF THE DRAWINGS

Drawings (1) to (3) in FIG. 1 are schematic illustrations showing the lateral cross-sectional shape of conjugate fibers according to the invention.

BEST MODE FOR CARRYING OUT THE INVENTION

Figure 1:
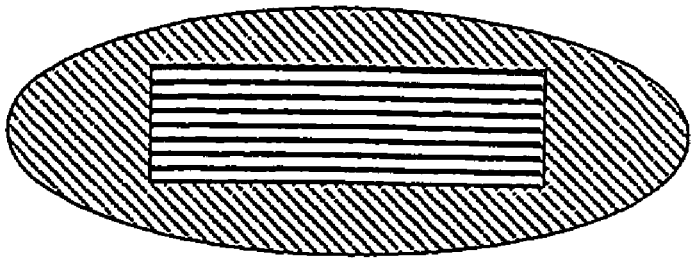
Figure 1:
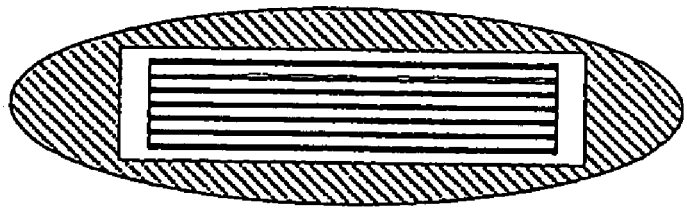
Figure 1:
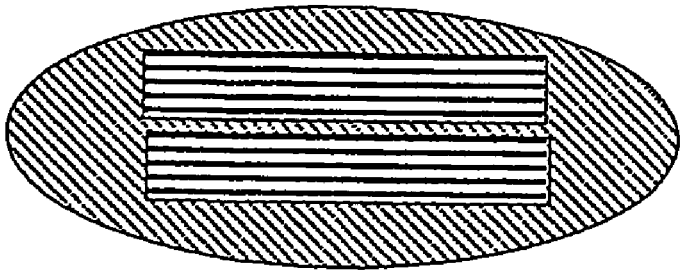

The cross-sectional structure of the conjugate fiber having an optical interference color-generating function according to the invention will now be explained with reference to the accompanying drawings. Drawings (1) to (3) in FIG. 1 are schematic representations of the cross-sectional shape of different conjugate fibers of the invention when cut at a right angle to the lengthwise direction, where each alternating laminated section comprising two different alkali-insoluble polymer layers has a flat cross-sectional shape, and the two different polymer layers are alternately laminated with multiple layers parallel to the long axis direction of the flat cross-section (the horizontal direction as seen in the drawing). Also, the circumference is surrounded by a covering layer composed of an alkali-soluble polymer, where (2) shows a form in which a separate alkali-insoluble protective layer is formed between them, and (3) shows a form in which the alternating laminated sections are simultaneously covered with an alkali-soluble polymer.

The thickness of each polymer layer in the alternating laminated section is preferably in the range of 0.02–0.5 μm. If the thickness is less than 0.02 μm or greater than 0.5 μm, it will be difficult to achieve the expected optical interference effect in a useful wavelength range. The thickness is more preferably in the range of 0.05–0.15 μm. A higher optical interference effect can be achieved if the optical distance, i.e. the product of the layer thickness and refractive index of the two different components is equal. More preferably, twice the sum of the two optical distances is equal to the length of the desired color, in order to maximize the interference color.

The cross-sectional shape of the alternating laminate perpendicular to the fiber axis direction of the conjugate fiber of the invention is flat as shown in FIG. 1, and it has a long axis (horizontal direction in the drawing) and a short axis (vertical direction in the drawing). A large flatness (long axis/short axis) of the cross-section permits a larger effective area for optical interference, and is therefore the preferred fiber cross-section form. When the flatness of the fiber cross-section is at least 3.5, preferably at least 4.5 and especially at least 7, it is easier to align the flat axis sides of the fibers together in the parallel direction during use, and the optical interference color-generating function is improved. If the flatness is too large, however, the reeling property is notably reduced, and therefore it is preferably no greater than 15 and especially no greater than 12. In cases where the protective layer described below composed of an alkali-insoluble polymer covers the outer periphery of the flat cross-section, the protective layer section is included in calculating the flatness.

The number of different independent polymer layers laminated together in the alternating laminated section, in a cross-section of the fiber of the invention, is preferably 10–120 layers. The optical interference effect is reduced with less than 10 laminated layers. With more than 120 laminated layers, however, not only can no further increase in light reflection be expected, but the spinneret structure becomes complex and reeling is hampered, while it is not easy to satisfy the conditions described hereunder for the thickness of the alternating laminated section, such that the object of the invention becomes difficult to achieve.

As explained above, the cross-sectional shape of the alternating laminated section of the conjugate fiber of the invention is a flat shape with a plurality of polymer layers with different refractive indices alternately laminated, and in terms of the optical interference function, parallelism of the alternating laminated layers, i.e. uniformity of the optical distance of each layer in both the long axis and short axis directions of the flat cross-section, is extremely important for the reflection intensity and the monochromaticity (color generation clarity). In order to form a flat laminated structure with a large interfacial area, it is important to control the laminated layer-forming process in the complex spinneret flow channel, the Barus effect after discharge, interfacial tension and the like, in order to realize a uniform laminated layer thickness, and for this purpose it is essential to specify the ratio of the solubility parameter (SP value) between the layers of polymers with different refractive indices. That is, the ratio (SP ratio) between the solubility parameter value of the higher refractive index polymer (SP1) and the solubility parameter value of the lower refractive index polymer (SP2) must be in the range of $0.8 \leqq SP1/SP2 \leqq 1.1$, and especially in the range of $0.85 \leqq SP1/SP2 \leqq 1.05$. Such a polymer combination allows a uniform alternating laminated structure to be easily obtained since it reduces interfacial tension acting at the interface when the alternating laminated layer flow of the two different polymers is discharged from the spinneret. On the other hand, if the SP ratio is outside of the aforementioned range, the discharged polymer flow will tend to be rounded due to surface tension; moreover, shrinkage force acts to minimize the contact area at the interface between the two polymer laminated layers, and since the laminated structure includes multiple layers the shrinkage force is commensurately increased, resulting in rounding as the laminated layer surfaces become curved and making it impossible to obtain a satisfactory flat shape. In addition, the Barus effect will become more prominent, whereby the polymer flow tends to swell after leaving the spinneret.

Examples of preferred combinations which satisfy the conditions described above include a combination of polymethyl methacrylate having an acid value of 3 or greater with polyethylene terephthalate copolymerized with a dibasic acid component having a metal sulfonate group at 0.3–10 mole percent per total dibasic acid component forming the polyester, a combination of an aliphatic polyamide with polyethylene naphthalate copolymerized with a dibasic acid component having a metal sulfonate group at 0.3–5 mole percent per total dibasic acid component forming the polyester, a combination of polymethyl methacrylate with an aromatic copolymer polyester copolymerized with a dibasic acid component or glycol component having a side chain alkyl group, at 5–30 mole percent per total repeating unit, a combination of polymethyl methacrylate with polyethylene terephthalate or polyethylene naphthalate copolymerized with 9,9-bis(parahydroxyethoxyphenyl)fluorene at 20–80 mole percent per total repeating unit, a combination of an aliphatic polyamide and polyethylene terephthalate or polyethylene naphthalate copolymerized with 9,9-bis(parahydroxyethoxyphenyl)fluorene at 20–80 mole percent per total repeating unit and a dibasic acid component having a metal sulfonate group at 0.3–10 mole percent per total dibasic acid component forming the polyester, a combination of polymethyl methacrylate and a polycarbonate comprising 2,2-bis(parahydroxyphenyl)propane as a dihydric phenol component, and a combination of polymethyl methacrylate and a polycarbonate comprising 9,9-bis(parahydroxyethoxyphenyl)fluorene and 2,2-bis(parahydroxyphenyl)propane (molar ratio: 20/80–80/20) as dihydric phenol components.

According to the invention, it is important for the thickness of the alternating laminated section to be no greater than 10 μm and preferably 2–7 μm. If the thickness exceeds 10 μm, it is not possible to obtain a fine conjugate fiber with an optical interference color-generating function even if alkali treatment is performed, and the object of the invention therefore cannot be achieved.

If necessary, there may also be provided on the alternating laminated section a protective layer composed of an alkali-insoluble polymer, with a thickness of 0.1–3 μm and preferably 0.3–1.0 μm. If this thickness is smaller than 0.1 μm the effect of the protective layer will be minimal, and if it is greater than 3 μm it will be difficult to obtain a fine fiber with an optical interference color-generating function even if treatment with an aqueous alkali solution is carried out.

There are no particular restrictions on the polymer forming the protective layer so long as it is alkali-insoluble, but preferably it has a solubility parameter value (SP3) at the same level as the solubility parameter of the polymer composing both sides in the long axis direction of the alternating laminated section (the higher refractive index polymer or lower refractive index polymer), and specifically $0.8 \leqq SP1/SP3 \leqq 1.2$ and/or $0.8 \leqq SP2/SP3 \leqq 1.2$ is preferred. If it is the same as the higher melting point polymer of the alternating laminated polymers, the protective layer section is first formed of the polymer with the higher melting point which has the higher cooling solidification rate during melt spinning, so that deformation of the flat cross-sectional shape due to interfacial energy and the Barus effect can be suppressed, and the parallelism of the laminated structure can be maintained for an improved aesthetic quality.

The conjugate fiber with an optical interference color-generating function according to the invention must have the aforementioned flat lateral cross-sectional shape, and the alternating laminated section comprising multiple independent polymer layers with different refractive indices laminated alternately parallel to the long axis direction of the flat cross-section (if necessary comprising a protective layer) must be covered with an alkali-soluble polymer having a thickness of 2.0 μm or greater, preferably 2.0–10 μm and most preferably 3.0–5.0 μm. By thus providing a covered layer made of an alkali-soluble polymer surrounding the alternating laminated section, it is possible to alleviate the polymer flow distribution at the areas near the wall sides and the interior which is received inside the final discharge opening during melt spinning. As a result, even with an alternating laminated section thickness of 10 μm or smaller, the shear stress distribution received by the laminated section is reduced and an alternating laminate is obtained with a more uniform thickness of each of the layers from the outside to the inside. Removal of the covering layer by alkali treatment of the obtained conjugate fiber can easily yield a fine conjugate fiber having an excellent optical interference color-generating function.

If the thickness of the covering layer is too thin, i.e. less than 2.0 μm, the single filament fineness of the fiber is reduced, and because of its flat cross-section, the condition in the spinning step is less favorable and problems are created for handling during the post-treatment step. When a covering layer made of an alkali-soluble polymer is provided directly surrounding the alternating laminated section, similar to when a protective layer made of an alkali-insoluble polymer is formed as described above, it preferably has a solubility parameter value (SP4) at the same level as the solubility parameter of the polymer composing both sides in the long axis direction of the alternating laminated section (the higher refractive index polymer or lower refractive index polymer). Specifically, $0.8 \leqq SP1/SP4 \leqq 1.2$ and/or $0.8 \leqq SP2/SP4 \leqq 1.2$ is preferred.

According to the invention, alkali-insoluble and -soluble polymers have a difference in alkali reduction rate of 10× or greater. Specifically, this means that the alkali-soluble polymer of the covering layer dissolves at a rate which is at least 10 times faster than that of the alkali-insoluble polymer composing the alternating laminated section during the aqueous alkali solution treatment. If the dissolution rate difference is less than 10-fold, the alternating laminated section will also undergo corrosion during the aqueous alkali solution treatment for removal of the covering layer, thus producing laminated layer thickness irregularities due to randomness or swelling in the laminated section, and reducing the optical interference color-generating function.

Examples of preferred alkali-soluble polymers include polylactic acid, polyethylene terephthalate or polybutylene terephthalate copolymerized with polyethylene glycol, or polyethylene terephthalate comprising polyethylene glycol and/or an alkali metal alkylsulfonate, or polyethylene terephthalate or polybutylene terephthalate copolymerized with polyethylene glycol and/or a dibasic acid component having a metal sulfonate group.

Polylactic acid is usually composed mainly of L-lactic acid, but it may also contain other copolymer components such as D-lactic acid in a range that does not exceed 40 wt %. Polyethylene terephthalate or polybutylene terephthalate copolymerized with polyethylene glycol preferably has a polyethylene glycol copolymerization ratio of 30 wt % or greater, in order to notably improve the alkali dissolution rate. Polyethylene terephthalate or polybutylene terephthalate comprising an alkali metal alkylsulfonate and/or polyethylene glycol preferably comprises the former in a range of 0.5–3.0 wt % and the latter in a range of 1.0–4.0 wt %, with the average molecular weight of the latter polyethylene glycol suitably in a range of 600–4000. Polyethylene terephthalate or polybutylene terephthalate copolymerized with polyethylene glycol and/or a dibasic acid component having a metal sulfonate group may comprise the former in a range of 0.5–10.0 wt % and the latter in a range of 1.5–10 mole percent per total dibasic acid component forming the polyester.

The conjugate fiber having an optical interference color-generating function according to the invention preferably has an elongation in the range of 10–60%, and especially in the range of 20–40%. If the elongation is too large, the tension load on the conjugate fiber may cause fiber deformation in the step of producing a textile or cut fibers, thus tending to reduce the process throughput. On the other hand, if the elongation is too small it will be difficult for the conjugate fiber to absorb the tension load, thus tending to increase fluff and filament breakage. Even if the elongation is within this range, certain types of polymers exhibit increase in the birefringence (Δn) when the spun and solid-cooled conjugate fiber is drawn, and since it is possible to achieve an overall increase in the difference between refractive indices, considering that the difference in refractive indices of the two different polymers is the "difference in the refractive indices of the polymers plus the difference in birefringence of the fibers", the optical interference color-generating function is increased.

Also, the conjugate fiber having an optical interference color-generating function according to the invention preferably has a heat shrinkage of no greater than 3% at 130–150° C. If the heat shrinkage exceeds this range, fiber shrinkage and other kinds of deformation that lower the optical interference color-generating function will tend to occur during the steps of producing various products such as cloths, embroidering yarn and cut fibers for paper, paints, inks, cosmetics and the like, during use in such products, and during maintenance of such products by ironing, etc. For example, when the fiber is used to produce a cloth, a shrinkage of greater than 3% at 150° C. will lead to shrinkage of the fibers when ironed, tending to cause deformation of the flat cross-section and reduce the optical interference color-generating function. When the shrinkage is particularly high, for example in cases where absolutely no heat treatment has been carried out for structural fixation during the reeling step, the thickness of each layer of the alternating laminated structure is increased and alteration tends to occur in the color phase of the optical interference color generation itself. For use as a paint, for example, since drying and heat fixation are carried out at the same temperature in the painting step or printing step, a similar level of heat resistance is preferred from the standpoint of quality.

The conjugate fiber having an optical interference color-generating function according to the invention as described above may be produced by the following method, for example. Specifically, following the method described in International Patent Publication 98/46815, first alkali-insoluble polymers with different refractive indices, in a combination such that the ratio (SP ratio) between the solubility parameter value of the higher refractive index polymer (SP1) and the solubility parameter value of the lower refractive index polymer (SP2) is in the range of $0.8 \leqq SP1/SP2 \leqq 1.1$, are melted and discharged to form an alternating laminated structure, during which time the alternating laminated structure is covered with an alkali-soluble polymer having a higher alkali dissolution rate than either the higher refractive index polymer or the lower refractive index polymer, to obtain an undrawn fiber having a structure with the alternating laminated section covered with the covering layer. The single filament fineness of the undrawn fiber will differ depending on the draw ratio, and it may be as desired so long as the fineness of the conjugate fiber with the optical interference color-generating function obtained after aqueous alkali solution treatment is no greater than 4.0 dtex and preferably in the range of 0.2–3.0 dtex. The thickness of the covering layer may be as desired so long as the thickness of the covering layer after drawing is at least 2.0 μm.

Drawing may be carried out as necessary, while the conditions therefor are not particularly restricted and may be conventionally known drawing conditions for undrawn fibers. For example, drawing may be carried out at any temperature near the glass transition temperature (Tg±15° C.) of the polymer with the highest glass transition temperature, which still allows orientation of the polymer molecule chains. The temperature in this case is the temperature of the heating medium, such as the heating plate or heating roller. The draw ratio may be set as appropriate depending on the degree of strength and elongation property or thermal shrinkage property to be imparted to the finally obtained drawn fiber, but in most cases drawing may be to a maximum draw ratio of 0.70–0.95. In order to improve the heat resistance, including the thermal shrinkage property, the drawing may be followed by heat treatment.

The conjugate fiber having an optical interference color-generating function according to the invention, which has been drawn and heat treated as necessary, may be used directly as filaments, or it may be cut for use as staple fibers. When staple fibers are produced they may be cut to a length suited for the purpose, and for application in such fields as paper, paints, inks, cosmetics and coatings, from the standpoint of handling properties during use and the aesthetic quality of the final product, they are preferably cut so that the fiber length in the fiber axis direction is longer than the short axis length of the fiber cross-section, ignoring the alkali-soluble polymer section. The upper limit for the length will usually be about 50 mm, and particularly for uses involving fine dispersion such as cosmetics and paints, it is preferably no greater than 1 mm. A shorter length is preferred so long as it is greater than the long axis length of the laminated section, and especially a length of a few tens to a few hundred μm is preferred.

When the conjugate fiber of the invention is to be used directly as filaments, for example, it may be employed to form a textile with a desired textile design, and then treated with an aqueous alkali solution to remove the alkali-soluble polymer and obtain a textile material composed of the fine conjugate fiber having an optical interference function.

On the other hand, when it is to be used as staple fibers, for example, they may be treated with an aqueous alkali solution beforehand to remove the alkali-soluble polymer, and then utilized in various ways as fine conjugate staple fibers having an optical interference function. Also, the conjugate fiber of the invention may be treated with an aqueous alkali solution while in skein form to remove the alkali-soluble polymer at a stage prior to producing staple fibers, and then cut afterwards.

EXAMPLES

The present invention will now be explained in greater detail through examples. The polymer solubility parameter value (SP value) and the dimensions of the fiber cross-section mentioned throughout the examples were measured by the following methods.

<SP Value and SP Ratio>

The SP value is the value represented by the square root of the cohesive energy density (Ec). The Ec of a polymer is determined by immersing the polymer in various solvents, and recording the Ec of the polymer as the Ec in the solvent with the maximum swelling pressure. The SP values for different polymers determined in this manner are listed in "PROPERTIES OF POLYMERS"3rd Edition (ELSEVIER), p. 792. For a polymer with an unknown Ec, it may be calculated from the chemical structure of the polymer. That is, it may be determined as the sum of the Ec values for each substituent in the polymer. The Ec values of different substituents are listed on page 192 of the aforementioned reference. The SP ratio of the alternating laminated section may also be calculated by the following formula.

SP ratio=SP value of high refractive index polymer (SP1)/SP value of low refractive index polymer (SP2)

<Fiber Cross-Section Measurement>

The sample fiber is affixed to a flat silicon plate and beam capsule, and embedded in an epoxy resin. Next, an ULTRACUT-S microtome is used for cutting in the direction perpendicular to the fiber axis to create ultrathin samples with thicknesses of 50–100 nm, which are mounted on a grid. After two hours of vapor treatment with 2% osmium tetraoxide at no higher than 60° C., an LEM-2000 transmission electron microscope is used for photography (20,000×) at an acceleration voltage of 100 kV. The mean thickness of each layer of the laminated structure section and the covering layer thickness were measured from the obtained photograph.

<Optical Interference Color-Generating Wavelength and Intensity>

A sample fiber (multifilament yarn) was wound on a black board at a winding density of 40 strands/cm and a winding tension of 0.265 cN/dtex (0.3 g/de), and colorimetry was performed using a Macbeth ColorEye 3100 (CE-3100) spectrophotometer, with a D65 light source. The measurement aperture was 25 mmϕ for the large aperture, and the peak wavelength and reflection intensity were measured under conditions including an ultraviolet light source. For the reflection intensity, the difference in reflection intensity at baseline and peak wavelength was determined as the net reflection intensity.

Examples 1–7 and Comparative Examples 1–2

The high refractive index polymer (Polymer 1) and the low refractive index polymer (Polymer 2) listed in Table 1 were melt spun in such a manner as to form a structure with 21 alternating laminated sections and an alkali-soluble polymer 3 covering the periphery thereof, and the structure was wound up at the speed shown in Table 1. The obtained undrawn fiber was then drawn at the draw ratio listed in Table 1 to obtain a conjugate fiber having an optical interference color-generating function, with the cross-sectional shape shown in FIG. 1(1). The evaluation results are shown in Table 2.

TABLE 1

| | High refractive index polymer | | Low refractive index polymer | | SP | Covering layer | | SP | Spinning | | Protective |
|---|---|---|---|---|---|---|---|---|---|---|---|
| | Polymer type | SP1 | Polymer type | SP2 | Ratio SP1/SP2 | Polymer type | SP4 | ratio SPn/SP4 | speed m/min. | Draw ratio | layer SP3 |
| Example 1 | Copolymer PEN1 | 19.1 | NY6 | 22.5 | 0.85 | PEGPBT | 20.4 | 0.94(1/4) | 1200 | 2.0 | — |
| Example 2 | Copolymer PET2 | 21.06 | PMMA | 18.3 | 1.15 | Polylactic acid | 19.9 | 1.06(1/4) | 2000 | — | — |
| Example 3 | Copolymer PEN2 | 19.46 | PMMA | 18.3 | 1.06 | Polylactic acid | 19.9 | 0.98(1/4) | 2000 | — | — |
| Example 4 | Copolymer PC | 21.45 | PMMA | 18.3 | 1.17 | Polylactic acid | 19.9 | 1.08(1/4) | 2000 | — | — |

TABLE 1-continued

| | High refractive index polymer | | Low refractive index polymer | | SP | Covering layer | | SP | Spinning | | Protective |
|---|---|---|---|---|---|---|---|---|---|---|---|
| | Polymer type | SP1 | Polymer type | SP2 | Ratio SP1/SP2 | Polymer type | SP4 | ratio SPn/SP4 | speed m/min. | Draw ratio | layer SP3 |
| Example 5 | Copolymer PET1 | 21.5 | NY6 | 22.5 | 0.96 | Copolymer PET | 20.9 | 1.03(1/4) | 2000 | 1.5 | — |
| Example 6 | Copolymer PET3 | 21.06 | NY6 | 22.5 | 0.94 | Copolymer PET | 20.9 | 1.01(1/4) | 2000 | 2.0 | |
| Example 7 | PC | 20.3 | PMMA | 18.3 | 1.11 | Polylactic acid | 19.9 | 0.92(2/4) | 3000 | — | — |
| Example 8 | PC | 20.3 | PMMA | 18.3 | 0.90 | Polylactic acid | 19.9 | 1.02(3/4) | 3000 | — | PC(20.3) |
| Comp. Ex. 1 | PEN | 18.9 | PET | 21.5 | 1.03 | PEGPET | 21.3 | 0.93(1/4) | 1000 | 3.0 | — |
| Comp. Ex. 2 | PS | 17.4 | NY6 | 22.2 | 0.77 | Polylactic acid | 19.9 | 0.87(1/4) | 2000 | — | — |

The abbreviations for the polymers in Table 1 are as follows.

PET: Polyethylene terephthalate

Copolymer PET1: Copolymer polyethylene terephthalate with 0.8 mole percent 5-sodiumsulfoisophthalic acid component Copolymer PET2: Copolymer polyethylene terephthalate with 70 mole percent 9,9-bis(parahydroxyethoxyphenyl) fluorene (BPEF)

PEGPET: Copolymer polyethylene terephthalate with 10 wt % polyethylene glycol of average molecular weight of 4000

Copolymer PET: Copolymer polyethylene terephthalate with 3 wt % polyethylene glycol of average molecular weight of 4000 and 6 mole percent 5-sodiumsulfoisophthalic acid

TABLE 2

| | Alternating laminated section | | | | Covering layer | Conjugate fiber | | Fiber properties after alkali treatment | | |
|---|---|---|---|---|---|---|---|---|---|---|
| | Flatness ratio | Polymer 1 thickness nm | Polymer 2 thickness nm | Thickness μm | Covering layer thickness μm | Flatness ratio | Total thickness μm | Laminated section | Interference wavelength nm | Coloring intensity % |
| Example 1 | 6.8 | 80 | 85 | 1.7 | 5 | 4.5 | 11.7 | no corrosion | 529 | 16 |
| Example 2 | 5.3 | 95 | 110 | 2.3 | 4 | 4.3 | 10.3 | no corrosion | 636 | 18 |
| Example 3 | 7.4 | 70 | 73 | 1.5 | 3 | 5.2 | 7.5 | no corrosion | 456 | 20 |
| Example 4 | 6.1 | 75 | 80 | 1.6 | 2 | 4.5 | 5.6 | no corrosion | 481 | 19 |
| Example 5 | 8.5 | 72 | 78 | 1.6 | 3 | 4.8 | 7.6 | no corrosion | 466 | 10 |
| Example 6 | 7.8 | 78 | 80 | 1.7 | 5 | 4.2 | 11.7 | no corrosion | 486 | 20 |
| Example 7 | 6.2 | 76 | 80 | 1.4 | 2 | 4.2 | 5.6 | no corrosion | 502 | 17 |
| Example 8 | 5.2 | 90 | 85 | 1.8 | 5 (0.7*) | 4.2 | 13.2 | no corrosion | 539 | 21 |
| Comp. Ex. 1 | 8.9 | 70 | 61 | 1.4 | 3 | 4.8 | 7.4 | some corrosion | 428 | 7 |
| Comp. Ex. 2 | 1.5 | 120 | 150 | 2.8 | 5 | 4.8 | 12.8 | no corrosion | 420 | 3 |

*Protective layer thickness = 0.7 μm (Example 8)

Copolymer PET3: Copolymer polyethylene terephthalate with 70 mole percent 9,9-bis(parahydroxyethoxyphenyl) fluorene (BPEF) and 0.8 mole percent 5-sodiumsulfoisophthalic acid component PEN: Polyethylene-2,6-naphthalate Copolymer PEN1: Copolymer polyethylene-2,6-naphthalate with 1.5 mole percent 5-sodiumsulfoisophthalic acid component Copolymer PEN2: Copolymer polyethylene-2,6-naphthalate with 70 mole percent BPEF PC: Polycarbonate Copolymer PC: Copolymer polycarbonate with 70 mole percent 9,9-bis(4-hydroxyethoxy-3-methylphenyl)fluorene (BCF)

PMMA: Polymethyl methacrylate

PS: Polystyrene

NY6: Nylon-6

PEGPBT: Copolymer polybutylene terephthalate with 50 wt % (5.2 mole percent) polyethylene glycol of average molecular weight of 4000

For Example 1, polyethylene-2,6-naphthalate copolymerized with 1.5 mole percent of 5-sodiumsulfoisophthalic acid, nylon-6, and polybutylene terephthalate copolymerized with 2.5 mole percent of polyethylene glycol of average molecular weight of 4000, were each melted at 290° C., 270° C., and 230° C., and after weighing were introduced into a spinning pack and spun at 1200 m/min. The obtained undrawn filament was drawn at the draw ratio of 2 with a preheating temperature of 60° C., and then heat set at 150° C. and wound up. The obtained conjugate fiber showed no damage to the alternating laminated section even after alkali treatment, and the interference reflection light of the obtained conjugate fiber was a clear green color. For Examples 2 and 3, polyethylene terephthalate (PET) or polyethylene-2,6-naphthalate (PEN) copolymerized with 70 mole percent 9,9-bis(parahydroxyethoxyphenyl)fluorene (BPEF), polymethyl methacrylate (PMMA), and polylactic acid were each melted at 300° C., 255° C. and 230° C., and after weighing were introduced into a spinning pack and spun at 2000 m/min. The obtained conjugate fibers all produced fine fibers and cut fibers with excellent color-generating performance. For Example 4, polycarbonate copolymerized with 70 mole percent 9,9-bis(4-hydroxyethoxy-3-methylphenyl)fluorene (BCF) was used for spinning in the same manner as Example 2, but with a melting temperature of 300° C. The obtained conjugate fiber had a clear color and strong reflection intensity. Also, the alternating laminated section suffered no damage in the aqueous alkali solution treatment step. For Example 5, PET copolymerized with 0.8 mole percent 5-sodiumsulfoisophthalic acid, nylon-6, and PET copolymerized with PEG for alkali solubility and 5-sodiumsulfoisophthalic acid, were spun at melting temperatures of 290° C., 270° C. and 290° C., respectively, and wound up at a speed of 2000 m/min. The obtained unstretched filament was preheated at 80° C., drawn at the draw ratio of 1.5 and heat set at 180° C. The reflection intensity was somewhat low due to a smaller refractive index difference compared to the other combinations, but the obtained conjugate fiber had excellent heat resistance and strength. For Example 6, PET copolymerized with 70 mole percent 9,9-bis(parahydroxyethoxyphenyl) fluorene (BPEF) and 0.8 mole percent 5-sodiumsulfoisophthalic acid, nylon-6, and PET copolymerized with PEG for alkali solubility and 5-sodiumsulfoisophthalic acid, were spun at melting temperatures of 290° C., 270° C. and 290° C., respectively, and wound up at a speed of 2000 m/min. The obtained undrawn filament was preheated at 80° C., drawn at the draw ratio of 2.0 and heat set at 180° C. The obtained conjugate fiber had excellent reflection intensity, heat resistance and solvent resistance. For Example 7, polycarbonate (PC) and PMMA were melted at 290° C. and 255° C. while polylactic acid was melted at 230° C., and they were weighed, introduced into a spinning pack and spun at 3000 m/min. The obtained conjugate fiber had a high degree of flatness and exhibited a strong, clear color. For Example 8, there was formed a cross-section provided with a PC intermediate protective layer formed surrounding the PMMA/PC laminated section (FIG. 1(2)). It was particularly excellent from the standpoint of heat resistance. For Comparative Example 1, however, PEN and PET, which have comparable SP values and are expected to have excellent uniform laminate-forming ability, and PET copolymerized with 10 wt % PEG, were melted at 310° C., 300° C. and 290° C., respectively, introduced into a spinning pack and spun at 1000 m/min. The spun fiber was drawn at the draw ratio of 3 with preheating at 80° C., and heat set at 180° C. Since the dissolution rate of the covering layer in the aqueous alkali solution was at least 3 times (no greater than 10 times) that of the polymers composing the alternating laminated section, alkali corrosion was observed in the alternating laminated section after treatment and the reflection intensity was notably reduced. For Comparative Example 2, nylon-6, polystyrene and polylactic acid were melted at 270° C., 270° C. and 230° C., respectively, introduced into a spinning pack and spun at 2000 m/min. Because the SP ratio for the polymers of the alternating laminated section was outside of the range of the invention, the layer thickness of the alternating laminated section was large, the optical interference color-generating function was insufficient and the reflection intensity was low, such that a clear color satisfying the object of the invention could not be achieved.

INDUSTRIAL APPLICABILITY

The conjugate fiber with an optical interference color-generating function according to the invention has satisfactory processing stability for reeling, and thus exhibits an excellent optical interference color-generating function even with a small alternating laminated structure thickness, while it is possible to easily obtain a fine fiber with an optical interference function either using the fiber directly as filaments, or by removing the covering layer after first cutting into staple fibers. Particularly when cut fibers of short lengths are produced, not only is the dispersibility suitable for utilization in paints, inks, coating agents, cosmetics and the like, but the surface smoothness of resulting products is also improved and the optical interference color-generating function and aesthetic quality are satisfactory.

What is claimed is:

1. A conjugate fiber with an optical interference color-generating function, having an alternating laminated section with a thickness of no greater than 10 μm, wherein alkali-insoluble polymer layers with different refractive indices are alternately laminated parallel to the long axis direction of the flat cross-section and the ratio (SP ratio) between the solubility parameter value of the higher refractive index polymer (SP1) and the solubility parameter value of the lower refractive index polymer (SP2) is in the range of $0.8 \leqq SP1/SP2 \leqq 1.1$, is covered with an alkali-soluble polymer with a thickness of 2.0 μm or greater.

2. A conjugate fiber with an optical interference color-generating function according to claim 1, wherein the alternating laminated section is covered with a protective layer having a thickness of 0.1–3.0 μm composed of an alkali-insoluble polymer.

3. A conjugate fiber with an optical interference color-generating function according to claim 1 , wherein the number of layers of the alternating laminated section is 10 or greater, and the flatness ratio of the flat cross-section is 3.5 or greater.

4. A conjugate fiber with an optical interference color-generating function according to claim 1, wherein the alkali-soluble polymer is polylactic acid, polyethylene terephthalate or polybutylene terephthalate copolymerized with polyethylene glycol, or polyethylene terephthalate comprising polyethylene glycol and/or an alkali metal alkylsulfonate, or polyethylene terephthalate or polybutylene terephthalate copolymerized with polyethylene glycol and/or a dibasic acid component having a metal sulfonate group.

5. A textile having an optical interference color-generating function, and produced by weaving a conjugate fiber having an optical interference color-generating function according to claim 1, and then treating it with an aqueous alkali solution.

6. Cut fibers having an optical interference color-generating function, and produced by cutting a conjugate fiber having an optical interference color-generating function according to claim 1, in such a manner that the fiber length in the fiber axis direction is longer than the short axis direction of the fiber cross-section, ignoring the alkali-soluble polymer section.

7. Cut fibers having an optical interference color-generating function, and produced by treating cut fibers according to claim 6 with an aqueous alkali solution.

8. Cut fibers having an optical interference color-generating function, and produced by treating a conjugate fiber having an optical interference color-generating function according to claim 1 with an aqueous alkali solution to remove the alkali-soluble polymer, and then cutting it in such a manner that the fiber length in the fiber axis direction is longer than the short axis direction of the fiber cross-section.

9. A conjugate fiber with an optical interference color-generating function according to claim 2, wherein the number of layers of the alternating laminated section is 10 or greater, and the flatness ratio of the flat cross-section is 3.5 or greater.

10. A conjugate fiber with an optical interference color-generating function according to claim 2, wherein the alkali-soluble polymer is polylactic acid, polyethylene terephthalate or polybutylene terephthalate copolymerized with polyethylene glycol, or polyethylene terephthalate comprising polyethylene glycol and/or an alkali metal alkylsulfonate, or polyethylene terephthalate or polybutylene terephthalate copolymerized with polyethylene glycol and/or a dibasic acid component having a metal sulfonate group.

11. A conjugate fiber with an optical interference color-generating function according to claim 3, wherein the alkali-soluble polymer is polylactic acid, polyethylene terephthalate or polybutylene terephthalate copolymerized with polyethylene glycol, or polyethylene terephthalate comprising polyethylene glycol and/or an alkali metal alkylsulfonate, or polyethylene terephthalate or polybutylene terephthalate copolymerized with polyethylene glycol and/or a dibasic acid component having a metal sulfonate group.

12. A textile having an optical interference color-generating function, and produced by weaving a conjugate fiber having an optical interference color-generating function according to claim 2, and then treating it with an aqueous alkali solution.

13. A textile having an optical interference color-generating function, and produced by weaving a conjugate fiber having an optical interference color-generating function according to claim 3, and then treating it with an aqueous alkali solution.

14. A textile having an optical interference color-generating function, and produced by weaving a conjugate fiber having an optical interference color-generating function according to claim 4, and then treating it with an aqueous alkali solution.

15. Cut fibers having an optical interference color-generating function, and produced by cutting a conjugate fiber having an optical interference color-generating function according to claim 2, in such a manner that the fiber length in the fiber axis direction is longer than the short axis direction of the fiber cross-section, ignoring the alkali-soluble polymer section.

16. Cut fibers having an optical interference color-generating function, and produced by cutting a conjugate fiber having an optical interference color-generating function according to claim 3, in such a manner that the fiber length in the fiber axis direction is longer than the short axis direction of the fiber cross-section, ignoring the alkali-soluble polymer section.

17. Cut fibers having an optical interference color-generating function, and produced by cutting a conjugate fiber having an optical interference color-generating function according to claim 4, in such a manner that the fiber length in the fiber axis direction is longer than the short axis direction of the fiber cross-section, ignoring the alkali-soluble polymer section.

18. Cut fibers having an optical interference color-generating function, and produced by treating a conjugate fiber having an optical interference color-generating function according to claim 2 with an aqueous alkali solution to remove the alkali-soluble polymer, and then cutting it in such a manner that the fiber length in the fiber axis direction is longer than the short axis direction of the fiber cross-section.

19. Cut fibers having an optical interference color-generating function, and produced by treating a conjugate fiber having an optical interference color-generating function according to claim 3 with an aqueous alkali solution to remove the alkali-soluble polymer, and then cutting it in such a manner that the fiber length in the fiber axis direction is longer than the short axis direction of the fiber cross-section.

20. Cut fibers having an optical interference color-generating function, and produced by treating a conjugate fiber having an optical interference color-generating function according to claim 4 with an aqueous alkali solution to remove the alkali-soluble polymer, and then cutting it in such a manner that the fiber length in the fiber axis direction is longer than the short axis direction of the fiber cross-section.

* * * * *